United States Patent [19]

Ollington

[11] Patent Number: 4,688,803

[45] Date of Patent: Aug. 25, 1987

[54] CASINO GAME TABLE AND DICE

[76] Inventor: Robert F. Ollington, 129 Nelson Road, South Melbourne, Australia

[21] Appl. No.: 852,072

[22] Filed: Feb. 28, 1986

Related U.S. Application Data

[63] Continuation of Ser. No. 624,271, Jun. 25, 1984, abandoned.

[51] Int. Cl.[4] ..... A63F 9/04

[52] U.S. Cl. ..... 273/274; 273/146

[58] Field of Search ..... D21/37; 273/274, 146

[56] References Cited

U.S. PATENT DOCUMENTS

| | | | |
|---|---|---|---|
| D. 227,967 | 7/1973 | Scarne | D21/37 |
| D. 263,975 | 4/1982 | Quiroga | D21/37 |
| 1,692,402 | 11/1928 | Barthel | 273/146 X |
| 4,247,114 | 1/1981 | Carroll | 273/274 |
| 4,312,508 | 1/1982 | Wood | 273/274 |
| 4,575,085 | 3/1986 | Ollington | 273/138 R |

OTHER PUBLICATIONS

El Panama Hotel Bank-Crap Layout, p. 244 of Scarne's Complete Guide to Gambling by John Scarne, 1961.

Scarne, John; Scarne's Encyclopedia of Games; 1973; Two-Up, pp. 571-573.

*Primary Examiner*—Anton O. Oechsle

*Attorney, Agent, or Firm*—Larson and Taylor

[57] ABSTRACT

A table dice game comprising a table surface upon which the game is to be played, the surface comprising a number of player positions, each of which has a location for at least one form of bet, the form of bet being indicated by the position on the location, a location for a bet made by the shooter, who is the person to throw the dice the game to be played with two or three dice, each die being formed such that only two results can be achieved no matter what is the final orientation of the dice whereby, when two dice are used, there are three apparently different results and, when three dice are used, there are four apparently different results, the players being able, before each throw of the die, to wager on at least one of the possible results.

8 Claims, 4 Drawing Figures

CASINO GAME TABLE AND DICE

This is a continuation of application Ser. No. 624,271, filed June 25, 1984, now abandoned.

BACKGROUND OF THE INVENTION

Whilst there are many different types of casino games, the public is interested in variety and the invention is adapted to provide a casino table game which has many of the characteristics of two-up, a game very popular in certain parts of the world and which is simple to play, easy to learn and which has a high degree of player involvement.

FIELD OF THE INVENTION

This invention relates to a table game and specifically relates to a table form of the game known as two-up which is particularly useful for casino applications.

In the conventional game of two-up, the object is, for a spinner, one of the players, to spin two coins so that they both land with a "head" uppermost and the spinner enters a bet on heads which is covered by one of the other players.

Other participants, and the spinner, can also enter side bets against each other on whether the coins will fall heads or tails.

In this game, if one coin falls heads and the other tails, called one of each, there is no result and the coins are re-spun.

SUMMARY OF THE INVENTION

The invention includes a casino game comprising a table and at least two dice, the table having a number of player positions each of which has a location for the reception of bets, a location for a bet made by the shooter, the person whose is to throw the dice, which bet can be of only one form, each die being so formed that each of the faces has one of two indicia, there being an equal number of indicia, the players, other than the shooter, being able, before each throw of the dice, to wager on at least one of the possible results.

The game may be played with two or three dice. If there are two dice there are three apparent results, two of one of the indicia, hereinafter for convenience called "heads", two of the other indicia, hereinafter called "tails", and one of each. It will be appreciated that there are four results available, one die showing heads and the other tails and vice vera and thus the chances of one of each being thrown is twice that of either two heads or two tails being thrown.

Alternatively, three dice may be used, and in this case there will always be a result in which two heads or two tails will occur and there can be, if required, acceptable results when three heads or three tails are thrown.

There are eight possible results from three dice, being three heads, three tails, three results showing two heads and one tail and three results showing two tails and one head.

BRIEF DESCRIPTION OF THE DRAWINGS

In order that the invention may be more readily understood reference will be made to the accompanying drawings, in which.

DETAILED DESCRIPTION OF THE PREFERRED EMBODIMENTS

Figures 1, 4:
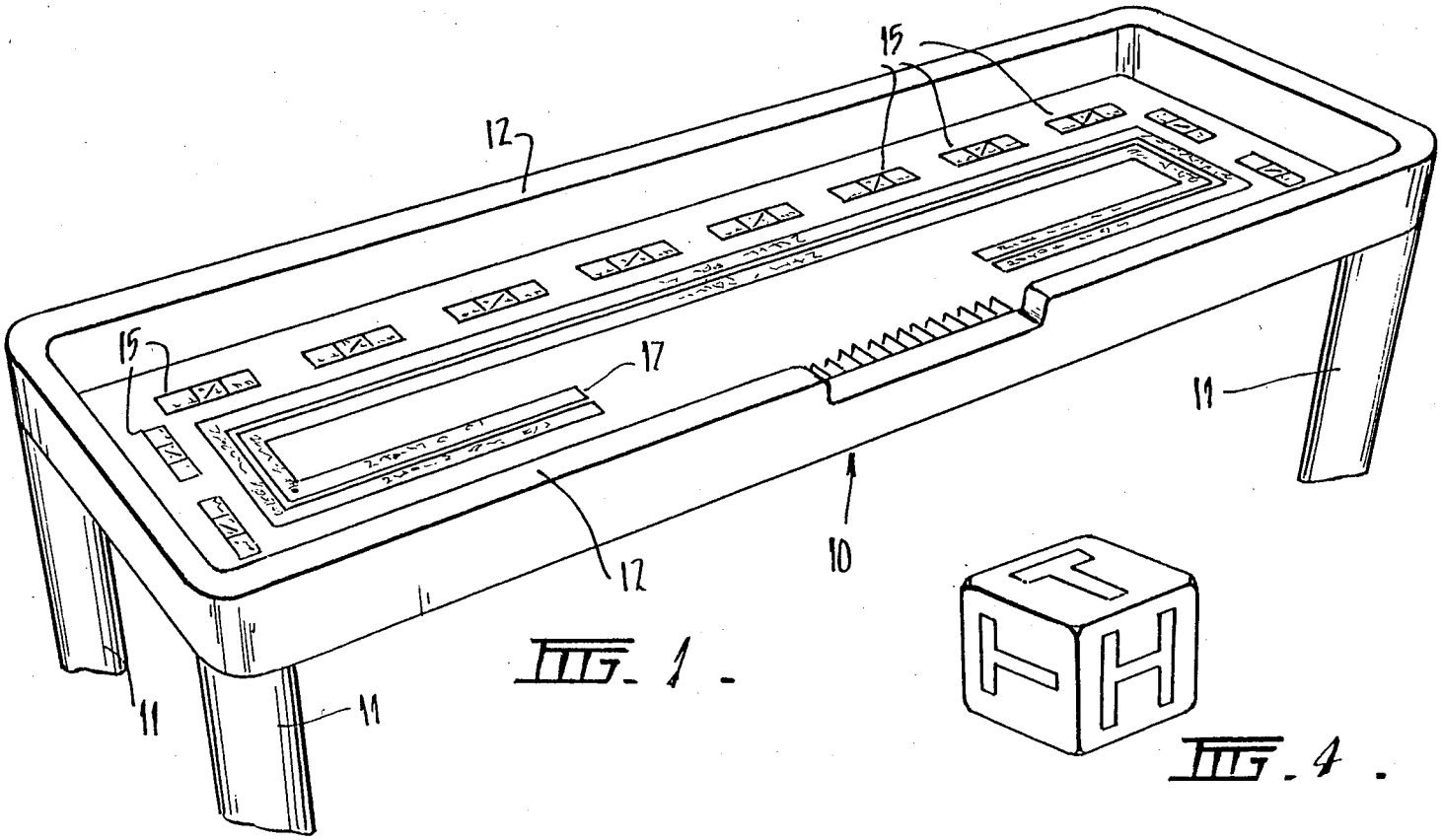
FIG. 1 is a perspective of the table of the present invention.
FIG. 4 is a perspective view of a die.
Figure 2:
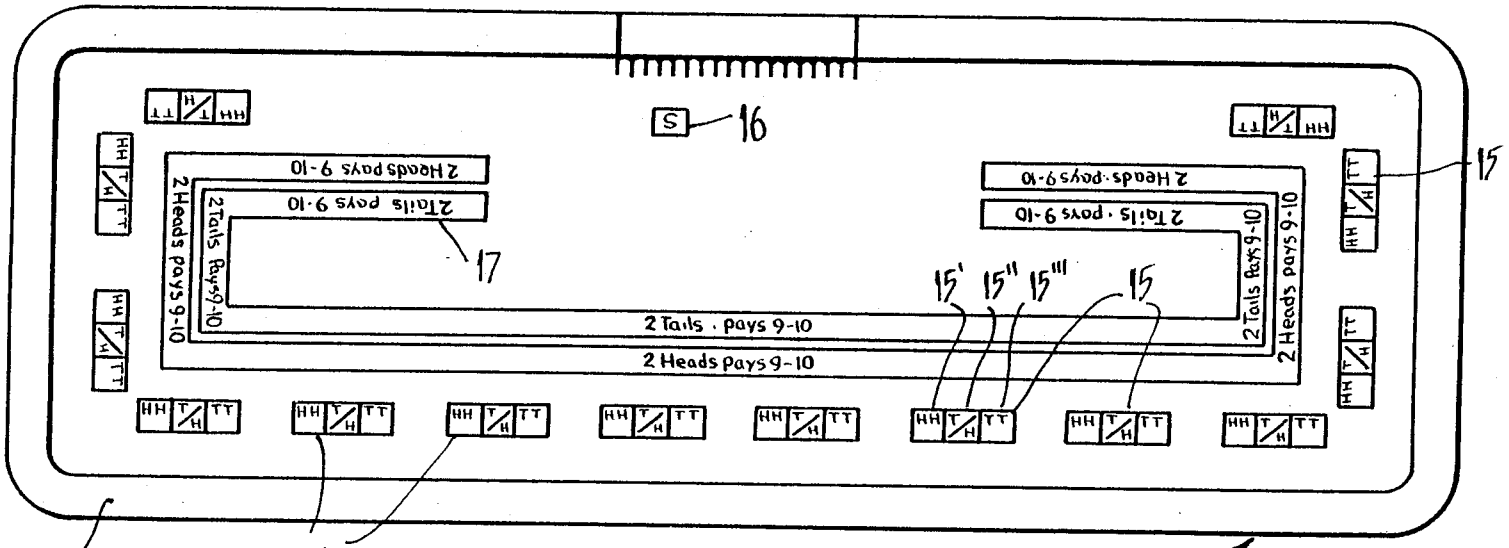
FIG. 2 is a plan view of the table surface.

The actual form of table is, of course, of no importance, the table being simply to support the table top at a height which is suitable for the players of the game.

As illustrated, the table has a top 10 and legs 11 and, about the periphery of the table there is a raised rim 12.

A suitable size of table is approximately 14 feet long by approximately 5 feet wide, but it will be appreciated that these dimensions can vary somewhat.

Located on the surface of the table, and about the periphery thereof, there are a number of player positions, each of which has a location 15 for the reception of bets and, in the illustrated form, each of these locations 15 has three positions 15', 15'', 15''', each of which can be used to receive a different bet, as will be described hereinafter.

The game is not limited to fourteen players, as a second form of bet, which will be described hereinafter, can be made and other players can make this form of bet.

As illustrated, the table has fourteen player positions but it will be appreciated that these numbers can vary and there is a space left along one side where there is a location at which the person controlling the handling of the chips is located. There is also a position 16, marked with an S, at which the bet of the shooter, that is the person who throws the dice, is placed.

Inwardly of the betting locations there is a band 17 which extends in front of the various betting locations. This band comprises a second betting location which can be used either by the fourteen players who are associated with the locations 15, or by other players.

Figure 3:
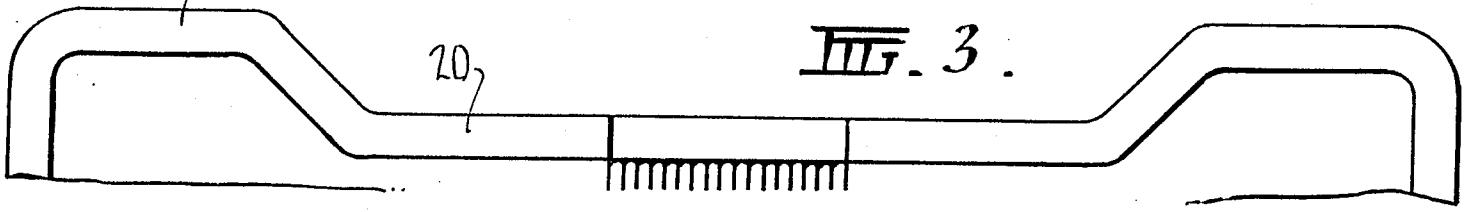
FIG. 3 is a plan view of an alternate table surface.

The table of FIG. 3 differs from that of the earlier figures in that there is a recess "20" in the table at the position at which the person who controls the game is located which recess gives easy access to the various betting positions.

The game is played with a pair of dice, illustrated in FIG. 4, which have only two markings, as illustrated an H and a T, although it will be appreciated that these markings could be any other indicia, for example, the two sides of a coin. There are equal numbers of each marking.

In order to play the game, one of the players is selected as the shooter, the person who is to roll the dice. Usually the first shooter is a person adjacent the person controlling the game and the privilege of shooting passes around the table, preferably in a clockwise direction.

By convention, the shooter can only bet on throwing heads and his bet is placed on the location 16. If considered desirable, the shooter can also be permitted to enter side bets in a manner similar to the other players.

Each of the other players may be permitted to bet on heads, tails and one of each.

The players' bets are indicated by placing betting chips on the positions 15', 15'', 15''' of the appropriate location 15.

Also, the band 17 provides an additional betting position where bets can be placed on two heads or two tails. Using this band any throw of one of each is a nullity, and the bets stand.

When all bets have been laid, the shooter throws the dice onto the table and the result of the game is dependent on the final combination of the upper surfaces of the die.

For bets on the locations 15, there will be a winning bet for one of the positions 15', 15" or 15''' and bets on the other two positions will be losing bets.

The true odds for these bets are, for two heads or two tails 3:1 against and for one of each, 1:1 (even money).

Depending upon the house rules, the house payment can come either from paying less odds than these true odds, so that overall there must be a house percentage, or, alternatively, by the house taking all bets lodged on a particular circumstance, for example, a five run of one of each being thrown in a row.

We prefer to pay on odds and, in one form we pay two to one for two heads or two tails and 4:6 for one of each. This gives an overall house take of 26%.

Alternatively, if we pay 5:2 for two heds or two tails and 4:5 for one of each, the house take is 10%.

If the first of these is adopted, the house take can be adjusted downwardly to a required percentage and the remainder of the money can be used to establish a jackpot for a shooter shooting a particular number, say ten, two heads in a row or the number separated by ones of each, but no tails.

The jackpot could be for the particular table or it could be for all the tables in a particular casino and it may be desired that associated with the table there is a display which indicates the approximate present value of the jackpot and also the number of consecutive throws of two heads.

For bets on the band 17 there are winning bets only when two heads or two tails are thrown. We prefer to use odds of 9:10 for bets on these bands. Such odds give a house take of 10%.

The shooter must bet on heads, in location 16 but may be able to hedge his bet either on location 15 or on the band 17.

The shooter normally continues to throw until two tails are thrown, at whch time his bet on location 16 is a losing bet, and the dice pass to the next shooter.

However, the rules of the game may permit the shooter to remove his original bet from location 16 after throwing one two heads, and thus he cannot lose when two tails are thrown and they may also permit him to cease shooting, at his option, after shooting say three two heads in a row, or broken only by ones of each.

If required, and possibly, if demanded by the licencing authority, the dice, instead of being thrown, could be in a cage of a known type and the indicia to be used are those which are directed upwardly when the dice come to rest after the cage has been rotated.

In order to make the game very simple for novice players, we prefer to color the H's and the T's on each die different colors and to mark the positions on locations 15 with the colors of the faces and also to delineate the portions of the band 17 by the colors of the indicia.

It will be seen that this particular game has the excitement of the ring game of two-up, it has a high degree of player participation, as each player may take his/her turn to be the shooter, and yet it is a game which is simple to learn and there are not the complicated rules of games such as, for example, Craps which can be difficult for many persons to learn.

Whilst I have described herein a game which used two dice, it is possible to play the game using three dice and it will be appreciated that in such a game the number of possible results increases. There are eight results possible, although these give only four apparently different results. The eight results are one three heads, one three tails, three two heads and one tail and three two tails and one head. If three dice are to be used it will be seen that the board would have to be varied to permit the required results to be shown and the odds selected would be varied to give the required result for the house.

I claim:

1. A casino game comprising:

two dice, each die being formed such that each face has one of two indicia with there being an equal number of each indicia on each die;

a table having a number of player positions and indicia for the reception of bets of a plurality of different forms at each player position, said table including an indicia for a bet to be made by a shooter who is a person designated to throw said dice which bet is of only one of the plurality of different forms, said table further including a raised rim around the periphery thereof;

such that players, other than the shooter, are able before each throw of the shooter to wager on at least one of the plurality of possible results.

2. A casino game as claimed in claim 1 wherein said indicia at each of the player positions has three forms for the placing of bets whereby the player can bet on any one of the results being obtained by the person who throws the dice.

3. A casino game as claimed in claim 2 wherein said table further includes a band of indicia extending in front of the player positions at which bets can be placed, the permissible bets of this band being of a different form from those of the indicia having three forms.

4. A casino game as claimed in claim 1 wherein there are two dice whereby there can be three possible apparent results.

5. A casino game as claimed in claim 1 wherein there are three dice whereby there can be four possible apparent results.

6. A casino game as claimed in claim 1 wherein the table further includes a position for a person who controls the game, and wherein the indicia for the single bet of the shooter is located immediately adjacent the position of the controller.

7. A casino game as claimed in claim 1 wherein said raised rim includes a shorter portion at the position of the controller.

8. A casino game as claimed in claim 7 and further including chip stacking means located on said table adjacent said shorter portion of said rim.

* * * * *